US009907347B2

(12) United States Patent
Allen

(10) Patent No.: US 9,907,347 B2
(45) Date of Patent: Mar. 6, 2018

(54) FLEX SPRING HELMET

(71) Applicant: Bell Sports, Inc., Scotts Valley, CA (US)

(72) Inventor: Scott Allen, Scotts Valley, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 192 days.

(21) Appl. No.: 14/790,968

(22) Filed: Jul. 2, 2015

(65) Prior Publication Data

US 2016/0000168 A1 Jan. 7, 2016

Related U.S. Application Data

(60) Provisional application No. 62/020,669, filed on Jul. 3, 2014.

(51) Int. Cl.

| | |
|---|---|
| ***A42B 3/04*** | (2006.01) |
| ***A42B 3/12*** | (2006.01) |
| ***A63B 71/10*** | (2006.01) |
| ***A42B 3/06*** | (2006.01) |
| ***A42B 3/08*** | (2006.01) |

(52) U.S. Cl.

CPC ..... *A42B 3/125* (2013.01); *A42B 3/04* (2013.01); *A42B 3/062* (2013.01); *A42B 3/08* (2013.01); *A63B 71/10* (2013.01)

(58) Field of Classification Search

CPC .. A42B 3/08; A42B 3/04; A42B 3/062; A42B 3/125; A63B 71/10

USPC ..... 2/414

See application file for complete search history.

(56) References Cited

U.S. PATENT DOCUMENTS

| | | | | |
|---|---|---|---|---|
| 3,315,273 | A * | 4/1967 | Bullard | A42B 1/08 2/418 |
| 5,271,103 | A * | 12/1993 | Darnell | A42B 1/08 2/411 |
| 6,154,889 | A * | 12/2000 | Moore, III | A42B 3/324 2/411 |
| 2002/0007508 | A1 * | 1/2002 | Grepper | A42B 3/324 2/420 |
| 2007/0157370 | A1 | 7/2007 | Joubert Des Ouches | |
| 2012/0047635 | A1 * | 3/2012 | Finiel | A42B 3/125 2/414 |

(Continued)

FOREIGN PATENT DOCUMENTS

| | | | |
|---|---|---|---|
| EP | 2205112 | A2 | 3/2012 |
| RU | 2112411 | C1 | 6/1998 |
| WO | WO2008085108 | A1 | 7/2008 |

*Primary Examiner* — Katherine Moran

(74) *Attorney, Agent, or Firm* — Booth Udall Fuller, PLC

(57) ABSTRACT

A helmet can include a helmet body formed of a foam energy-absorbing material in which the helmet body includes inner and outer opposing surfaces. A plurality of lower slots can be formed completely through the helmet body and can be open at a lower edge of the helmet body. A plurality of upper slots can be formed completely through the helmet body and be open at a top portion of the helmet body to form a star shape. An S-shaped panel of the helmet body can include an undulating form from the alternating and overlapping positions of the plurality of lower slots and the plurality of upper slots. A reinforcing halo can be disposed within the helmet body to reinforce areas of weakness in the helmet body resulting from the plurality of lower slots and the plurality of upper slots.

20 Claims, 10 Drawing Sheets

(56) References Cited

U.S. PATENT DOCUMENTS

2015/0305428 A1* 10/2015 Lakes ..... A42B 3/142
2/421

* cited by examiner

FLEX SPRING HELMET

RELATED APPLICATION

This application claims the benefit of U.S. provisional patent application 62/020,669, filed Jul. 3, 2014 titled "Flex Spring Helmet," the entirety of the disclosure of which is incorporated by this reference.

TECHNICAL FIELD

This disclosure relates to a helmet comprising a flexible spring like body formed of an energy-absorbing material and a method for making and using the same.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact. Different types of helmets have been used for different industries and for different applications.

SUMMARY

A need exists for an improved helmet. Accordingly, in an aspect, a helmet can comprise a helmet body formed of a foam energy-absorbing material, the helmet body comprising an outer surface and an inner surface opposite the outer surface, a plurality of lower slots formed in the helmet body that extend completely through the helmet body from the outer surface to the inner surface, the plurality of lower slots being open at a lower edge of the helmet body, a plurality of upper slots formed in the helmet body that extend completely through the helmet body from the outer surface to the inner surface, the plurality of upper slots being open at a top portion of the helmet body to form a star shape, an S-shaped panel of the helmet body comprising an undulating form that is formed by the alternating and overlapping positions of the plurality of lower slots and the plurality of upper slots, and a reinforcing halo disposed within the helmet body to reinforce areas of weakness in the helmet body resulting from the plurality of lower slots and the plurality of upper slots.

Particular embodiments of the helmet may comprise one or more of the following. The overlapping positions of the plurality of lower slots and the plurality of upper slots may comprise an upper slot crossing a connecting line formed between upper ends of two lower slots by a distance in a range of 2-5 centimeters (cm). The foam energy-absorbing material may comprise EPS, EPP, EPTU, or EPO. The helmet may be configured such that a force in a range of 22-66 Newtons applied to the helmet will reduce a width of one of the plurality of upper slots or one of the plurality of lower slots by a distance greater than or equal to 5 millimeters (mm). A side portion of the helmet may comprise a total of at least three slots. At least one of the plurality of upper slots or at least one of the plurality of lower slots may comprise a height Hs in a range of 7.5-15.5 centimeters (cm). The reinforcing halo may comprise an annular shape and is disposed within the S-shaped panel without being exposed by the plurality of lower slots or the plurality of upper slots.

In an aspect, a helmet may comprise a helmet body formed of a foam energy-absorbing material, the helmet body comprising an outer surface and an inner surface opposite the outer surface, a plurality of lower slots formed in the helmet body that extend completely through the helmet body from the outer surface to the inner surface, the plurality of lower slots being open at a lower edge of the helmet body, a plurality of upper slots formed in the helmet body that extend completely through the helmet body from the outer surface to the inner surface, the plurality of upper slots being open at a top portion of the helmet body, and an S-shaped panel of the helmet body comprising an undulating form that is formed by the alternating and overlapping positions of the plurality of lower slots and the plurality of upper slots.

Particular embodiments of the helmet may comprise one or more of the following. Straps disposed through openings in the helmet body at opposing sides of the lower plurality of slots. The helmet may be formed of a unitary helmet body without an outer shell disposed over the helmet body. A bike snap disposed within the helmet body and extending from the outer surface to the inner surface. The foam energy-absorbing material may comprise EPS, EPP, EPTU, or EPO. The overlapping positions of the plurality of lower slots and the plurality of upper slots may comprise an upper slot crossing a connecting line formed between upper ends of two lower slots by a distance in a range of 2-5 centimeters (cm). An annular shape halo in-molded within the S-shaped panel of the helmet body without the halo being exposed by the plurality of lower slots or the plurality of upper slots.

In an aspect, a helmet may comprise a helmet body formed of a foam energy-absorbing material, the helmet body comprising an outer surface and an inner surface opposite the outer surface, a plurality of lower slots formed in the helmet body that extend completely through the helmet body from the outer surface to the inner surface, the plurality of lower slots being open at a lower edge of the helmet body, and a plurality of upper slots formed in the helmet body that extend completely through the helmet body from the outer surface to the inner surface, the plurality of upper slots being open at a top portion of the helmet body.

Particular embodiments of the helmet may comprise one or more of the following. Straps disposed through openings in the helmet body at opposing sides of the lower plurality of slots. The helmet may be formed without outer shell disposed over the helmet body. The foam energy-absorbing material may comprise EPS, EPP, EPTU, or EPO. The overlapping positions of the plurality of lower slots and the plurality of upper slots may comprise an upper slot crossing a connecting line formed between upper ends of two lower slots by a distance in a range of 2-5 centimeters (cm). An annular shape halo in-molded within the S-shaped panel of the helmet body without the halo being exposed by the plurality of lower slots or the plurality of upper slots.

DETAILED DESCRIPTION

Figure 1A:
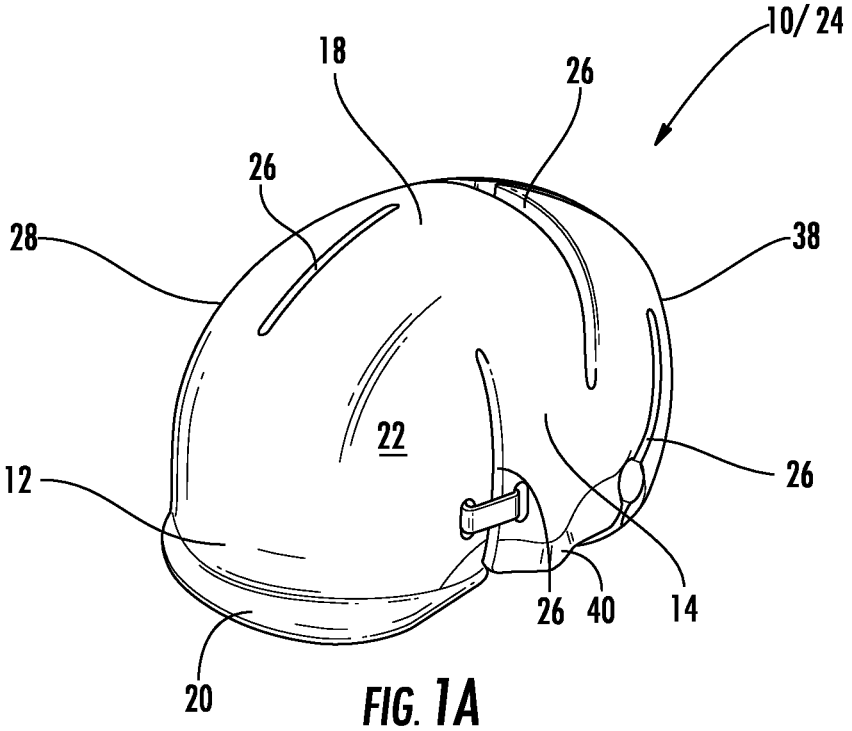
FIGS. 1A-1K show features of an embodiment of a protective flex helmet.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

Accordingly, this disclosure discloses protective headgear, as well as a system and method for providing a helmet or protective headgear, that can be used for a cyclist, football player, hockey player, baseball player, lacrosse player, polo player, climber, auto racer, motorcycle rider, motocross racer, skier, snowboarder or other snow or water athlete, sky diver or any other athlete in a sport. Other non-athlete users such as workers involved in industry, including without limitation construction workers or other workers or persons in dangerous work environments can also benefit from the protective headgear described herein, as well as the system and method for providing the protective head gear.

FIG. 1A shows a first perspective view of an embodiment of a flex spring helmet or helmet 10 showing a front portion 12, a left side 14, and top portion 18 of the helmet 10. The front 12 of the helmet 10 is shown disposed at the left of FIG. 1A and may optionally include a brim or visor 20 that can be integrally formed with the helmet 10 as a singularly molded piece.

The flex spring helmet 10 can include one or more energy-absorbing layers 22 that form a helmet body 24. The energy-absorbing layer 22 can comprise, or be formed of, a material that is hard and rigid enough to protect a user's head while withstanding impacts, and at a same time be soft and flexible enough to allow for flex in the helmet 10. As used herein, flex refers to at least the physical movement or bending of the helmet 10 or helmet body 24 under an applied force F, whether a compressive force Fc or a tensile force Ft, or when subjected to a bending moment. In an embodiment, the helmet 10 can be flexed or bent during a crash event or impact without breaking or being damaged. The helmet body 24 and the energy-absorbing layer 22 can comprise any suitable energy-absorbing material, such as, without limitation, a rigid foam material including expanded polystyrene (EPS), expanded polypropylene (EPP), expanded polyurethane (EPTU or EPU), expanded polyolefin (EPO), Vinyl Nitrile (VN), and any other materials used by those of ordinary skill in the art of making protective helmets. In some embodiments, the helmet body 24 can be made of elastic closed cell foams that together with the structural organization and geometries of the helmet 10 achieve greater flex and energy mitigation than with conventional helmets with different structural organization and geometries. For example, conventional protective helmets comprising rigid foam energy-absorbing layers have contributed to energy management by being crushed or permanently deformed in non-elastic or non-plastic ways.

In contrast, the helmet 10 can comprise flex in the helmet 10 and the helmet body 24 that can be achieved as a result of both the rigid foam materials selected for the helmet together with the geometries of the helmet, including slots, openings, gaps, or channels 26 that can be formed within, or as part of, the helmet body 24. The inclusion of slots 26 formed as part of the helmet body 24 can allow for flex of the helmet 24, which can result from elastic or non-plastic deformation of the helmet body 24 due to the spring-like structure resulting from the geometry of the helmet body 24. Helmet flex can provide a number of benefits including self-adjustment for a better fit on heads comprising unique topographies and sizes, as well as allowing for energy management without crushing or destroying the helmet 10. Details of helmet geometry, including a number and position of the slots 26 within the helmet are discussed in greater detail below.

In some embodiments, the helmet body 24 can comprise a unitary form, including a single layer unitary form, without the addition of an outer shell disposed over or around the helmet body 24. Alternatively, the flex spring helmet 10 can comprise, or be additionally formed with, an optional outer shell that can be disposed over or outside of an outer surface 28 of the helmet body 24. The depictions of the flex spring helmet in FIGS. 1A-1K illustrate an embodiment in which the helmet 10 includes the inner energy-absorbing layer 22 without an outer shell. However, an outer shell could, in some instances, be formed of a flexible or semi-flexible material comprising plastics such as Acrylonitrile Butadiene Styrene (ABS), Kevlar, fiber materials including fiberglass or carbon fiber, or other suitable material can also be added. In some instances, an outer rigid shell with one or more moveable segments or portions can be added to accommodate the flex or movement of the helmet body 24 or the energy-absorbing layer 22. With respect to energy management through flexing, the flex spring helmet 10 is not a conventional bucket style flexible helmet in which the energy management through flexing is principally or substantially achieved through flex and movement of the outer shell, such as an ABS outer shell. Instead, the energy management of the flex spring helmet 10 comes through movement or flex of the foam energy-absorbing layer 22 that also provides energy management through being crushed or plastically deformed.

The one or more energy-absorbing layers 22 can be formed of a single layer or type of material, or of multiple layers, strata, lamina, or portions of materials with different attributes selected to assist in different types of energy management and different types of impacts. The energy-absorbing layer 22 and helmet body 22 can also be formed comprising multiple energy management materials of multiple densities or to be multi-density. For example, a segment of the energy-absorbing layer 22 can comprise a first or outer layer, lamina, or strata of a first density that will be positioned closest to the outer surface 28, and a second or inner layer, lamina, or strata of a second density that will be positioned closer to the user's head and farther from the outer surface 28. The first layer can have a density that is greater than or less than a density of the second layer. Alternatively, different individual pieces or segments of the energy-absorbing layer 22 can comprise a single density that is different from other individual pieces to form an alternative embodiment of a multi-density liner. In some instances, the energy-absorbing layers 22 can be used to form the helmet body 24 through an in-molding process.

FIG. 1A also shows the helmet body 24 can comprise s number of slots, openings, gaps, or channels 26 formed through the helmet body 24 or through the energy-absorbing material 22. As such, the slots 26 can extend completely through the energy-absorbing material 22 from an outer surface 28 of the helmet body 24 to an inner surface 29 of the helmet body 24 that is formed opposite the outer surface 28, so that a distance between the outer surface 28 and the inner surface 29 defines a thickness T of the helmet body 24. Additionally, the thickness T can be measured in a direction that is perpendicular to the outer surface 28, the inner surface 29, or both. In some instances, the thickness T of the helmet can be constant or substantially constant for an entirety of the helmet, such as in a range of about 10-30 millimeters (mm), plus or minus about 10 mm. In other instances, the thickness T of the helmet body 24 can vary across the helmet 10. For example, a thickness Te along a lower edge 40 of the helmet body 24 can be tapered and be less than the thickness T of the helmet body 24 away from the lower edge 40. As a non limiting example, the edge thickness Te can be about a third to a half less than the thickness T, such as the edge thickness Te being about 10 mm, and the helmet thickness T can be about 15-10 mm. Similarly, a brim thickness Tb, or a thickness of the helmet 24 at the brim 20, can include an additional or increased thickness to account for the thickness of the brim 20. The brim thickness Tb can be thicker than the helmet thickness T, such as in a range of about 30-45 mm, or an additional thickness that will extend for a brim width Wb and a brim height Hb, as shown for example in FIGS. 1B and 1H. In some instances, the brim thickness Tb can be in a range of about 5-15 mm, plus or minus up to 5 mm, the brim height Hb can be in a range of about 10-20 mm, plus or minus up to 5 mm, and the brim width Wb can be in a range of about 12-18 cm plus or minus up to 3 cm.

By forming the slots 26 completely through the thickness T of the helmet body 24, the helmet body 24 is able to flex, elastically deform, and temporarily change one or more of a size, shape, or position by, increasing or decreasing in size of the slots 26 before returning to its original position, size, or shape. Thus, the helmet body 24, even being formed of materials that have conventionally been considered rigid and not flexible, such as foams including EPS, EPP, and EPO, can comprise the ability to flex and deform as part of the flex spring helmet 10 to absorb energy during impacts by flexing. The flex and deformation of the energy-absorbing layer 22, including material such as EPS, EPP, EPO that have conventionally been considered rigid materials, can thus provide energy management through elastic (or non-plastic) deformation instead of by being crushed in plastic (or non-elastic) deformation, especially for low energy impacts. As forces and energy of an impact increase, the flex spring helmet 10 can also provide energy management through both elastic deformation, which occurs first, and subsequently plastic deformation, through crushing which occurs after forces or energy exceed the elastic threshold. Thus, the elastic deformation that has conventionally been reserved for other "flexible" materials like vinyl nitrile foam, can also be achieved by more rigid materials, such as EPS, EPP, EPO, due at least in part to the use and position of slots 26. Additionally, the use of more rigid or non-flexible materials such as EPS, EPP, EPO as part of the flex spring helmet 10 and part of the helmet body 24 can allow for two stage energy management by first providing energy management through elastic deformation and then providing additional energy management through more traditional plastic deformation or crushing of the EPS, EPP, EPO foam, which is not available with conventional flexible materials like vinyl nitrile foam.

Figure 1B:
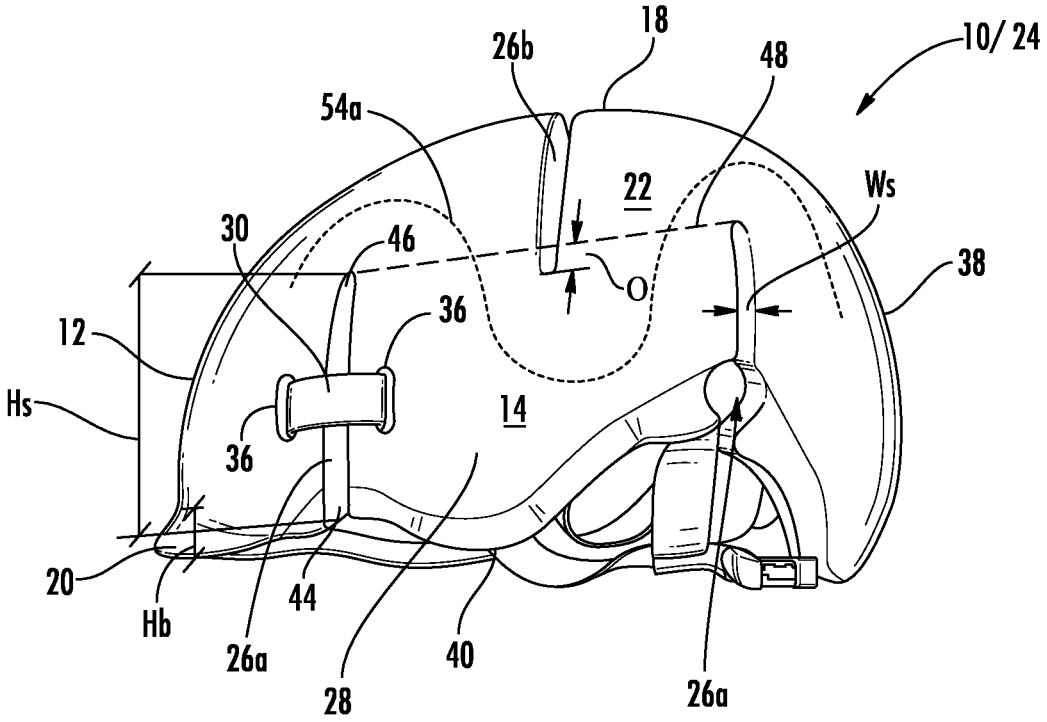

FIG. 1B, illustrates a side view of a left side of the flex spring helmet 10, with the front of the helmet 12 shown at the left side of FIG. 1B. As indicated above, the size, position, location, and number of slots 26 formed in the helmet body 24 can contribute to, and control, an amount of flex experienced by the helmet body 24. While FIGS. 1A-1K illustrate a non-limiting example or configuration of a particular arrangement of configuration of slots 26, other configurations including different numbers, sizes, shapes, and orientations of the slots 26 is also contemplated. In some embodiments, the slots 26 formed in the helmet body 24 can be used not only for helmet flex, but also for air ventilation that can facilitate passage of air from the outer surface 28 of the helmet body 24 to a user's head to cool the user. Slot configurations should enable the both proper helmet flex and ventilation while still adhering to, and successfully passing relevant test standards, such as national test standards, international test standards, or both, to enable proper safety certification of the helmet 10. The above considerations were addressed for the configuration of the helmet 10 and the placement of the slots 26 shown in FIGS. 1A-1K.

FIG. 1B shows that lateral portions of the helmet body 24, such as the left side 14 of the helmet 10 can comprise a plurality of slots including lower slots 26*a*. Lower slots 26*a* of the plurality of slots 26 can comprise a lower end 44 at the lower edge 40 of the helmet body 24 from which the lower slot 26*a* extends upwards. The lower slots 26*a* of the plurality of the slots 26 can terminate at an upper end 46 at or near the top portion 18 of the helmet body 24. A connecting line 48 can be formed by connecting upper ends 46 of more than one lower slot 26*a* to show a height or level to which the lower slots 26*a* extend on the helmet body 24. The lower ends 44 of the lower slots 26*a* can intersect the lower edge 40 of the helmet body 24 so that the lower slots 26*a* are open to an exterior of the helmet body 24, and can be understood to be unbounded, thereby allowing flex of the helmet 10. Thus, the lower edge 40 of the helmet body 24 together with the lower slots 26*a* form a crenulated shape that extends along the lower edge 40 of the helmet body 24, and also extends upwards along the left side 14 of the helmet towards the top portion 18 of the helmet 10.

A second portion of slots or upper slots 26*b* of the plurality of slots 26 can extend from the top portion 18 or centerline of the helmet body 24 towards the lower edge 40 of the helmet body 24. More specifically, the upper slots 26*b* can comprise an upper end 50 at or near the top portion 18 of the helmet body 24 and a lower end 52 above the lower edge 40 of the helmet body 24. The upper slots 26*b*, opposite the lower slots 26*a*, can be bounded or closed at the lower end 52, and open, connected, unbounded, or less restricted at the upper end 50 or top portion 18 to allow for flex or movement of the helmet 10. As shown in greater detail in the bottom and top views of FIGS. 1H and 1I, respectively, multiple upper slots 26*b* can intersect to form a star shape pattern or a plus shape pattern 27 with intersecting or radiating upper slots 26*b* that can extend from, the upper or top portion 18 of the helmet body 24 so as to allow for flexing and elastic deformation of the helmet body with respect to the top portion of the helmet. As such, the star shape 27 of intersecting upper slots 26*b* can comprise any number of points or legs, including two points, three points, four points, five points, or more.

From the top portion 18 of the helmet body 24, the lower ends 52 of the upper slots 26*b* can extend below, or be positioned below, the connecting line 48. One or more of the lower slots 26*a* can also be disposed between two adjacent upper slots 26*b*; and similarly, one or more of the upper slots 26*b* can also be disposed between two adjacent lower slots 26*a*. As such, the lower slots 26*a* and the upper slots 26*b* can be alternately arranged and overlapping. As shown in FIG. 1B, on the left side 14 of the helmet body 24, at least two lower slots 26*a* can extend upward from the lower edge 40 of the helmet, while a third upper slot 26*b* can be disposed between the two lower slots 26*a* can extend downward from the top 18 of the helmet below a level of the connecting line 48. In other embodiments, the arrangement shown in FIG. 1B can be reversed with least two upper slots 26*b* extending downward from the top portion 18 of the helmet 10, while a third lower slot 26*a* can be disposed between the two upper slots 26*b*.

A length or height Hs of the slots 26 can be in a range of about 5-18 centimeters (cm), or about 7.5-15.5 cm, and commonly about 10-13 cm, which can allow for overlap O among the lower slots 26*a* and the upper slots 26*b* in a range of about 0-5 cm or 3-4 cm. A width of the slots Ws without loading or when "at rest" can include widths in a range of about 3-9 mm, or about 4-8 mm, or about 5-7 mm, or about 6 mm. An amount of overlap O, as well as the width Ws, the height Hs, and the number of slots 26 can be increased or decreased to adjust the flexibility of a particular helmet 10 according to the configuration, design, and final application of the helmet 10. In some embodiments, the slots 26, such as lower slots 26*a* and upper slots 26*b*, may have no overlap O on the helmet body 24, including at the middle or at central latitudes of the helmet. Wider, taller, and more numerous slots 26 tend to increase a flexibility of the helmet body 24, requiring less force for the helmet body 24 to deform for a given material and density. Alternatively, thinner, shorter, and less numerous slots 26 tend to decrease a flexibility of the helmet, requiring more force for the helmet body 24 to deform for a given material and density. Alternating upward and downward orientations of the slots does not have to follow a fixed pattern or scheme, or alternate every-other upper slot 26*a* and lower slot 26*b*, as shown in FIGS. 1B and 1E.

As a result of the arrangement of the plurality of lower slots 26*a* and the arrangement of the plurality of upper slots 26*b*, the helmet body 24 can comprise one or more S-shaped or spring shaped panels 54*a*, 54*b*, including a left side S-shaped or spring shaped panel 54*a*, a right side S-shaped or spring shaped panel 54*b*, and a rear S-shaped or spring shaped panel 54*c*. The flexibility created by the S-shape panels 54*a*, 54*b* contributes to the flex energy management shown in, and described with respect to, FIGS. 1C and 1D.

FIG. 1B also shows that a lower slot 26*a* can be widened or enlarged at a portion along the height Hs of the slot 26*a* to form a tubing opening 60. The tubing opening 60 can be sized, shaped, or configured to be mateably coupled to a piece of tubing 62, such as a piece of tubing on a bicycle, like bicycle handles, or another piece of tubing 62 forming part of a bicycle rack, mount, stand, or other structure. The flex of the helmet 10 can allow the tubing opening 60 to first be opened or flexed to a size that is larger than a size of the tubing 62, to second be disposed around the tubing 62, and then third to be closed around the tubing 62 to releasably couple the helmet 10 and the tubing opening 60 to the tubing 62 as shown in the non-limiting example of FIG. 1K.

FIG. 1B further shows that the helmet 10 can also includes a number of straps or securing straps 30 for securely and releasably coupling the helmet 10 to a head of a user. The straps 30 can be made of fabric, cloth, cord, rope, or any suitable material comprising nylon or the like. The straps 30 can be formed as multiple straps such as a first strap 32 for a left side of the helmet 10 and a right strap 34 formed for a right side of the helmet, wherein the first strap 32 and the second strap 34 can be releasably coupled together using a clip, fastener, rings, snaps, hook and loop fastener, or any other suitable coupling apparatus for securing the straps around the head of the user, such as below the chin. The straps 30 can be coupled to the helmet 10 using a number of rivets, screws, or other fastening devices that can be made of metal, plastic, or other suitable material that can be attached to the helmet body 24 or to the outer shell. In other instances, the straps 30 can be coupled to the helmet 10 by having portions or ends of the straps 30 disposed through strap openings 36 in the energy-absorbing material 22 of the helmet body 24. In some instances, such as that shown in FIG. 1B, the strap openings 36 can be disposed around or at opposing sides of one or more slots 26, which can additionally limit or reduce an amount of flex occurs to the helmet body by causing the straps 36 to share with the helmet body 24 forces applied to the helmet body 24. As shown in FIG. 1B, strap openings 36 can be placed in the helmet body 24 to coincide, or align, with or near slot 26. Strap openings 36 can be formed straddling, or on opposing sides of, slots 26 so that a strap can pass through both to the opposing strap openings and such that the strap 30 extends across or around the slot 26. As a non-limiting example, strap openings can be disposed at a front 12 of the helmet 10, near a temple of the helmet wearer. Similarly, additional strap openings 36 can be placed near or at a rear 38 of the helmet 10, including along a lower edge 40 of the helmet 10.

Figure 1C:
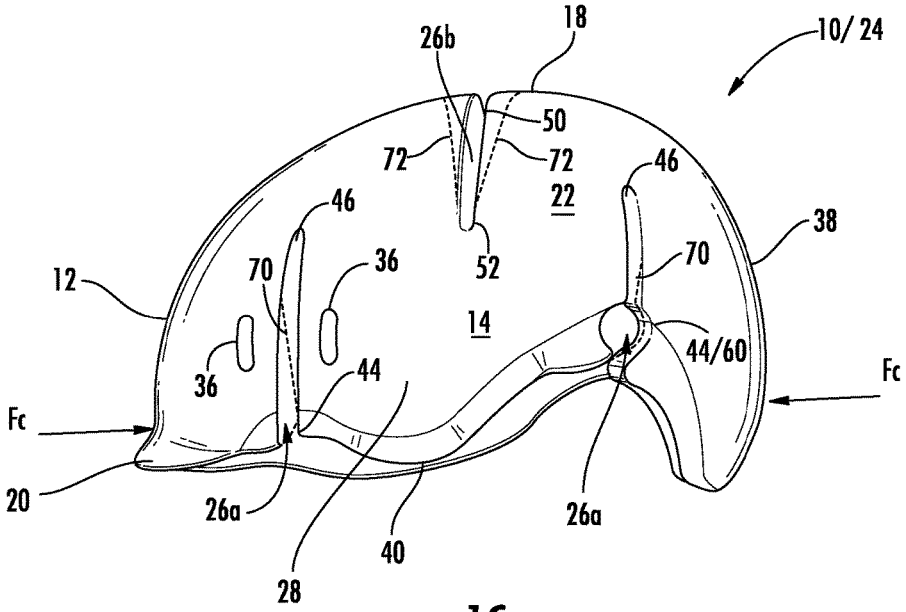
Figure 1D:
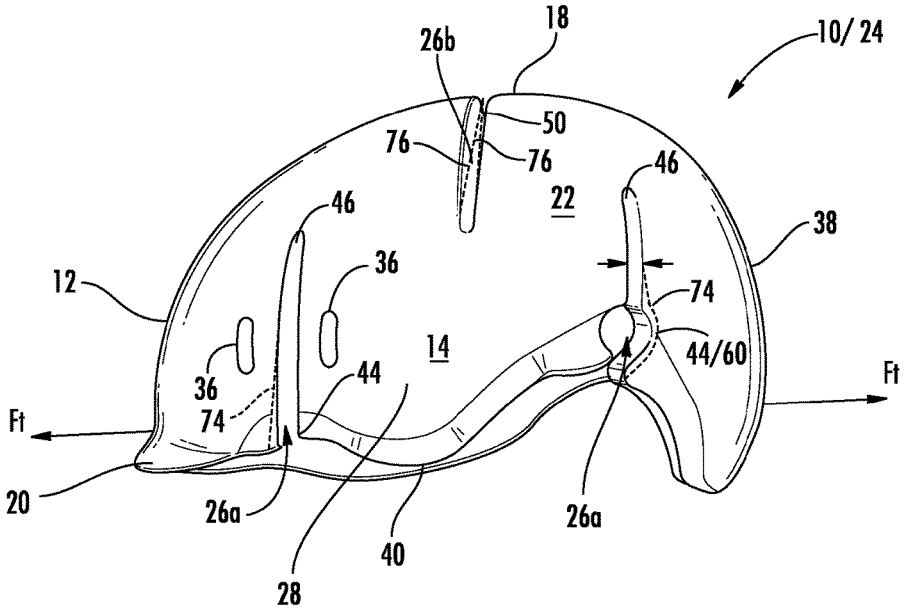
Figure 1E:
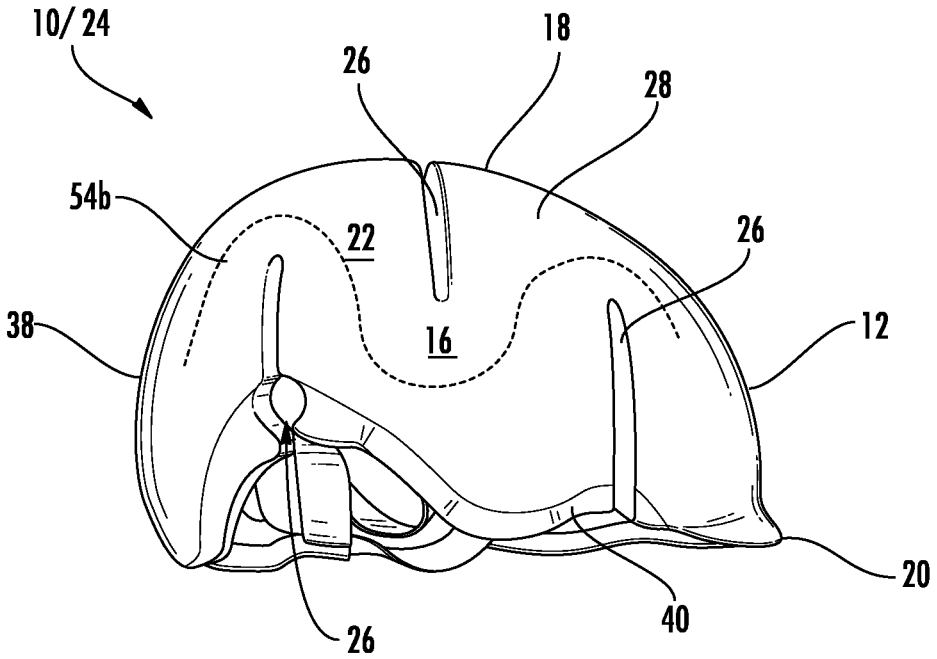

FIGS. 1C and 1D show profile views similar to the view of FIG. 1B that illustrate how the flex helmet 10 can flex and deform when various forces are applied to the helmet 10 or the helmet body 24. FIG. 1C shows a compressive force Fc applied at opposing sides of a lower portion of the helmet 10 to close or narrow the lower ends 44 of the lower slots 26*a* as shown with dashed or phantom lines 70 showing a position of closed lower slots 26*a*. At a same time, the compressive force Fc opens or widens the upper ends 50 of the upper slots 26*b* as shown with dashed or phantom lines 72 showing a position of open upper slots 26*b*.

Similarly, FIG. 1D shows a tensile force Ft applied at opposing sides of a lower portion of the helmet 10 to open or widen the lower ends 44 of the lower slots 26*a* as shown with dashed or phantom lines 74 showing a position of open lower slots 26*a*. At a same time, the tensile force Ft closes or narrows the upper ends 50 of the upper slots 26*b* as shown with dashed or phantom lines 76 showing a position of closed upper slots 26*b*.

With respect to the elastic deformation of helmet body 24 shown by phantom lines 70, 72, 74, and 76 in FIGS. 1C and 1D, the deformation of the helmet body 24 and the helmet 10 can be controlled or facilitated, at least in part, through one or more of the size, position, or shape of slots 26, and the movement or change of the position, size, or shape of the slots 26. The deformation of the helmet body 24 and the helmet 10 can be controlled by the material used for the helmet body 24, the geometry of the helmet body 24, including the thicknesses of the helmet body 24, the position, size, and number of the straps 30 and an amount of force applied to the straps, such as portions of the straps 30 spanning the slots 26. The deformation of the helmet body 24 and the helmet 10 can be controlled by an amount, size, and position of reinforcement included within the helmet body 24, as discussed in greater detail with respect to FIGS. 2A-2D.

FIG. 1E shows the right side 16 of the helmet 10, which is a mirror image of the left side 14 of the helmet 10 shown in FIG. 1B. FIG. 1E shows the flex spring helmet 10 with slots 26 at rest, in which the slots 26 are positioned and sized with alternating lower slots 26*a* and upper slots 26*b* positioned so that the right side spring shaped or S-shaped panel 54*b* can be clearly seen. The S-shaped panel 54*b* can be formed in a serpentine, undulating, or "S" type pattern, similar to a spring coil, in which the alternating configuration of the slots can allow for the alternate or opposing slots to widen and narrow to facilitate flexing of the helmet.

Figure 1F:
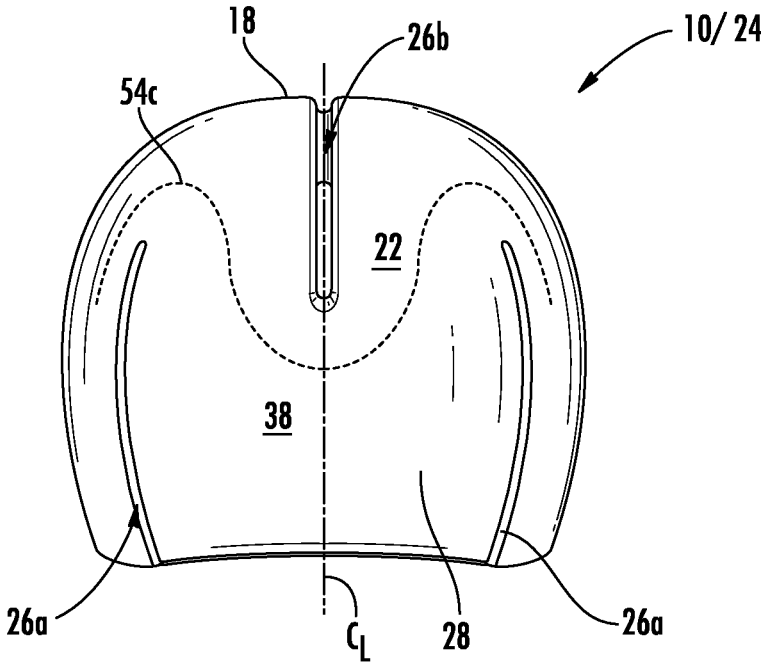

FIG. 1F, illustrates a rear view of or back view of the rear 38 of the flex spring helmet 10. The lower slots 26*a* and the upper slots 26*b* shown on the rear 38 of the helmet 10 or helmet body 24 can extend along, or near, a centerline CL of the helmet 10 or helmet body 24 and allow for bending and flex of the helmet 10 between the opposing left side 14 and right side 16 of the helmet 10 in a direction that is transverse or perpendicular to the front to back movement of the helmet 10 shown in FIGS. 1C and 1D. While the rear 38 of the helmet 10 is shown in FIG. 1F comprising two lower slots 26*a* and one upper slot 26*b*, the relative placement of the upper slots and lower slots could be reversed with one lower slot 26*a* and two upper slots 26*b*, or any other number or combination of slots 26.

Figure 1G:
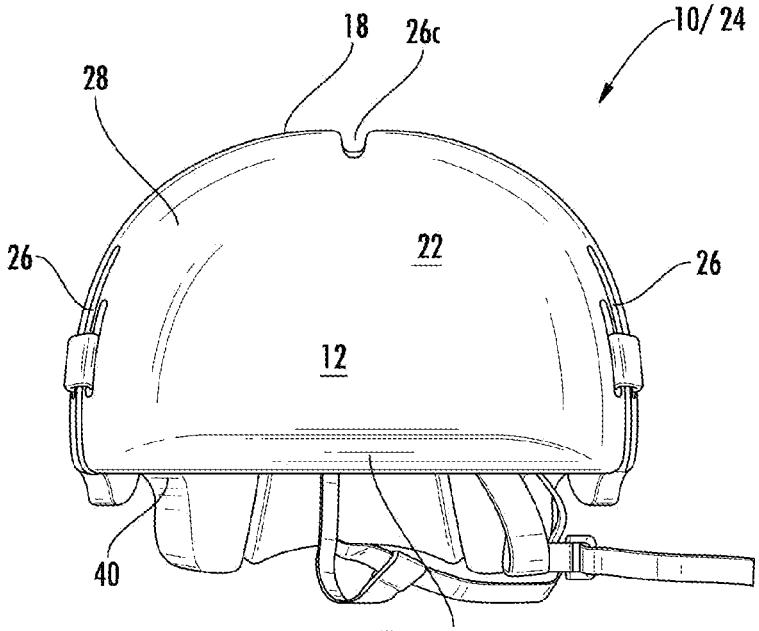

FIG. 1G, illustrates a front view of the front 12 of the flex spring helmet 10. As shown FIG. 1G, the front portion 12 of the helmet 10 can be devoid or substantially devoid of slots 26, so that relative movement of the helmet 10 is not enabled at the front 12 of the helmet 10 and so that the front portion 12 of the helmet does not expand or contract. Alternatively, slots 26 similar to the slots 26 formed in the rear 38 of the helmet 10 can also be formed in the front 12 of the helmet 10 or helmet body 24 to allow for expansion and contraction of the front 12 of the helmet 10 as a result of the relative movement or flexing of the helmet 10. FIG. 1G shows an embodiment in which one of the upper slots 26*b* extends partially into the front 12 of the helmet 10.

Figure 1H:
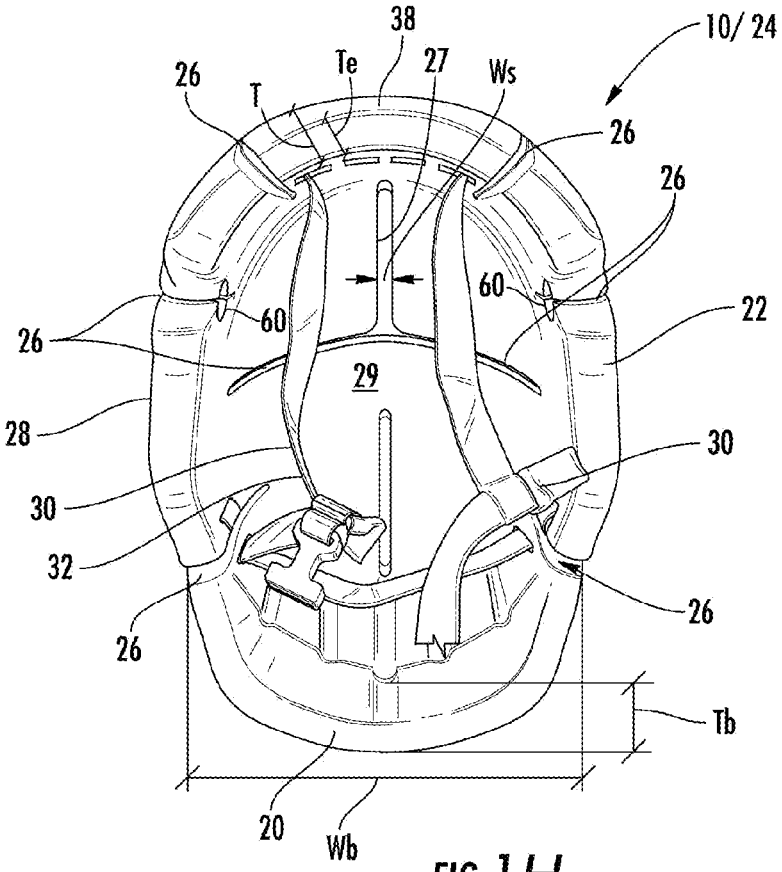

FIG. 1H, shows a bottom view of the flex spring helmet 10 that shows the inner surface 29 of the helmet 10 or helmet body 24. A non-limiting example of spacing and positioning for the slots 26 in the helmet body 24 is shown with respect to the inner surface 29 of the top portion 18 and the inner surface 29 of the lower edge 40 of the helmet 10 or helmet body 24. The upper slots 26*b* formed in the top portion 18 of the helmet 10 can be arranged so that an entirety of the upper slots 26*b* or a portion of the upper slots 26*b* less than an entirety of the upper slots 26*b* can be joined or intersect in the star shaped pattern 27. FIG. 1H shows an embodiment in which three separate slots 26 intersect at or near a central part of top portion 18 of the helmet 10 to form the star shape 27. As shown in FIG. 1H, a first of the three intersecting upper slots 26*b* can be disposed on the left side 14 of the helmet body 24, a second of the three intersecting upper slots 26*b* can be disposed in the right side 16 of the helmet 10, and a third of the three intersecting upper slots 26*b* can be disposed along the centerline CL of the helmet 10 and extend along the rear 38 of the helmet 10. A fourth non-intersecting upper slots 26*b* can be disposed along the centerline CL of the helmet 10 and extend along the top 18 and front 38 of the helmet 10. Some slots 26, like the fourth non-intersecting upper slots 26*b* can be completely contained within the helmet body 24 so that the slot 26 is bordered on at least four sides by the helmet and the slot 26 does not intersect with, and is not exposed at, an outer edge of the helmet 10, such as at the lower edge 40 of the helmet 10. While three intersecting lines are shown, any number of intersecting and non-intersecting slots 26 are contemplated as part of the disclosure and can be used to form the upper slots 26, including the star shape 27.

The star shape 27 can divide the helmet body 24 into the S-shaped panels 54*a*, 54*b*, which can include portions of approximately equal size and spacing between the slots 26. For example, the slots 26 can be spaced at equal or regular intervals, or with a constant number of degrees separating each slot, e.g. 120 degrees separating each of three upper slots 26*b* or approximately 90 degrees separating each of four upper slots 26*b*, whether or not all of the upper slots 26*b* intersect to form the star shape 27. As used herein, an approximate number of degrees can include variation of plus or minus 20 degrees or less, 10 degrees or less, or 5 degrees or less. Alternatively, the upper slots 26*b* can divide the S-shaped panels into portions of differing sizes so that the slots 26 are spaced at differing or irregular intervals, such as with a variable number of degrees separating each slot, e.g. 160 degrees, 100 degrees, and 100 degrees separating each of three slots, although any number of slots and any number of degrees can be used.

As a non-limiting example, FIG. 1H shows the star shape 27 with three intersecting upper slots 26*b*, and a fourth non-intersecting slot 26*b* that divide the top portion 18 of the helmet 10. A same or different number of lower slots 26*a* and upper slots 26*b* can be formed in the helmet body 24. As shown in the embodiment of FIGS. 1A-1K, the number of lower slots 26*a* can be different than the number of upper slots 26*b*, such as six and four slots respectively, although other numbers of slots 26 can also be used.

Thus, the at-rest width Ws of the slots 26 being changed as force F is applied to the helmet 10 as shown and discussed with respect to FIGS. 1C and 1D will also affect the width Ws of the slots 26 shown in FIG. 1H. Accordingly, the width Ws of the upper slots 26*b* forming the star 27 can also be increased or decreased as the force F is applied to the helmet 10 or helmet body 24. The force F can cause elastic deformation of the helmet body 24 such that the lower edge 40 of the helmet body 24 can move together to increase the width Ws of the upper slots 26*b* at the top portion 18 of the helmet 10. Alternatively, the force F can elastically deform or move the lower edge 40 of the helmet body 24 apart to decrease the width Ws of the upper slots 26*b* at the top portion 18 of the helmet 10 such that a size of the center of the star 27 can decrease as portions of the lower edge 40 are separated. In instances when the force F is sufficient, the slots 26 can be brought together so that opposing sides of the slots 26 touch and reduce the width Ws of at least a portion of the slots 26 to zero. By allowing for flex among separate portions of the S-shaped panels 54*a*, 54*b*, energy from impacts or forces F applied to the helmet can be managed and absorbed through movement and elastic deformation of the S-shaped panels 54*a*, 54*b* of the helmet body 24 without crushing or collapsing the energy-absorbing layers 22. Additionally, a better fit for the helmet 10 can be achieved by elastic deformation of the helmet body 24 including the inner surface 29, and further including one or more of a shape, form, or contour, of the S-shaped panels 54*a*, 54*b* by flexing to better match a shape, form, or contour, of a user's head when the helmet is flexed.

Figure 1I:
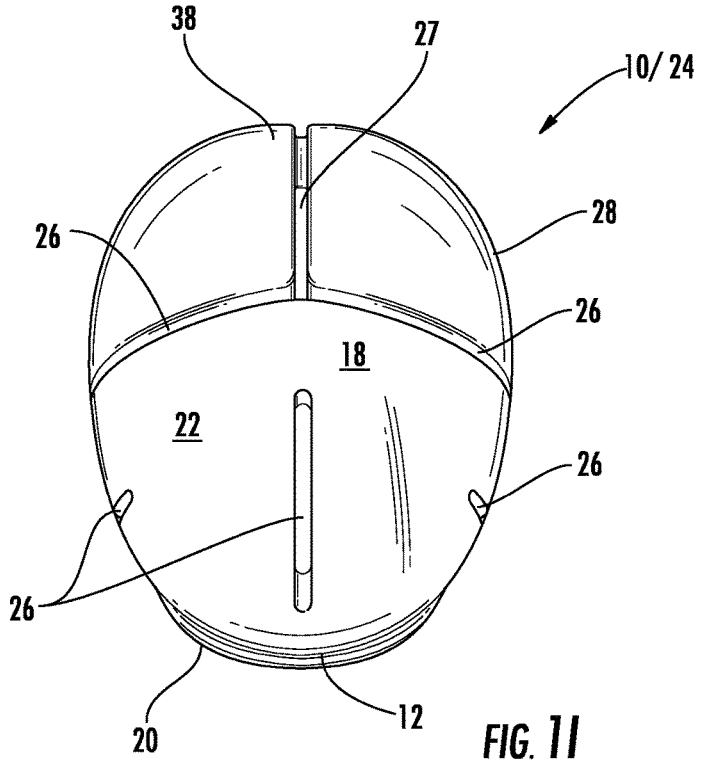

FIG. 1I, shows a top view of an embodiment of a flex spring helmet 10. FIG. 1I shows the outer surface 28 of the top portion 18 of the helmet 10 opposite the bottom view shown in FIG. 1H. FIG. 1I further shows a portion of the upper slots 26*b* intersecting to form the star shape 27 and an additional upper slot 26*b* formed in the front portion 12 and top portion 18 of the helmet 10 that does not intersect with the star shape 27 nor extend to the lower edge 40 of the helmet body 24. Upward extending lower slots 26*a* coming from the lower edge 40 of the helmet 10 are also visible.

Figure 1J:
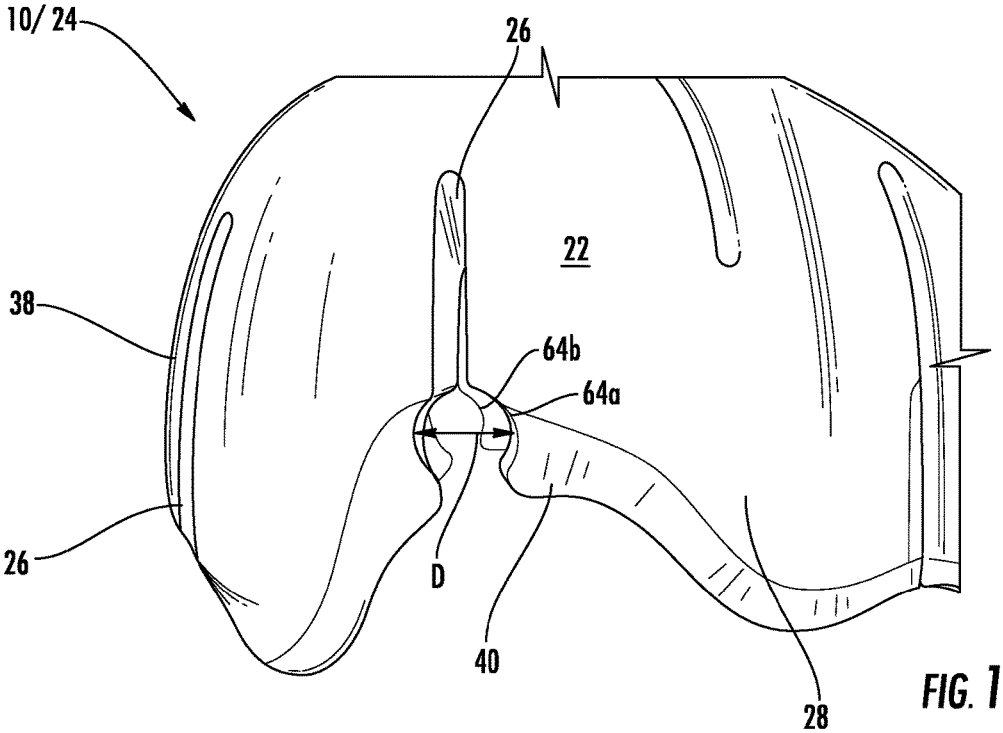
Figure 1K:
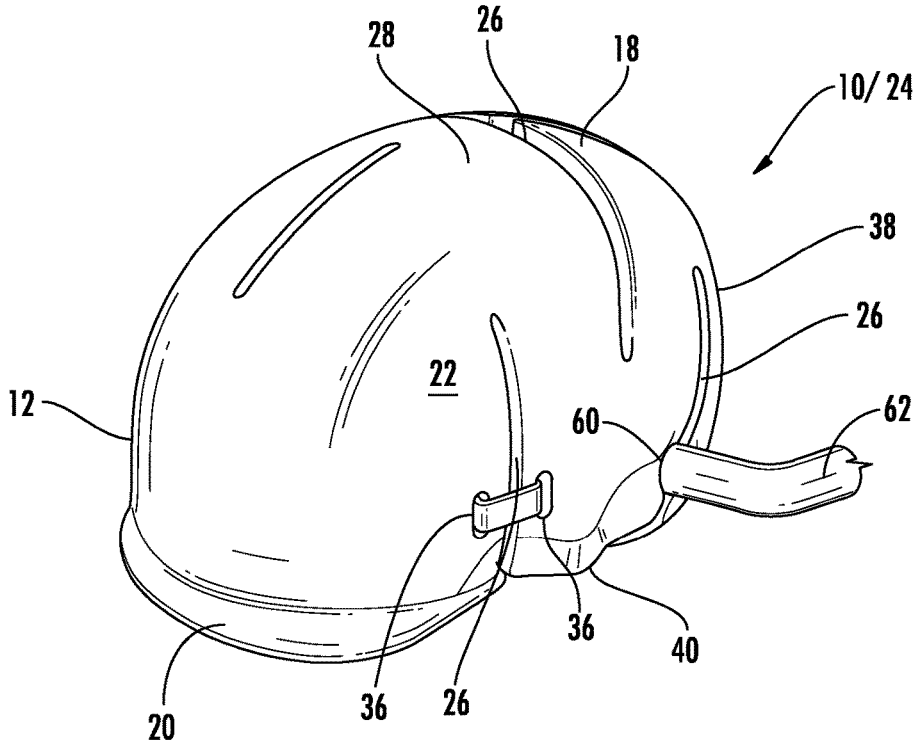

FIGS. 1J and 1K show the additional feature of a bike snap or tubing opening 60. FIG. 1J illustrates a close-up profile view of a portion of helmet 10 surrounding the bike snap 60 shown previously in FIG. 1E. As shown, the bike snap 60 can be formed as enlarged openings or circular cut-outs disposed within, or overlaid on, one or more of the slots 26 formed within the helmet body 24.

A diameter or width D of the bike snap 60 can be equal to, or slightly smaller than, a diameter or width of a portion of a bicycle, such as a piece of bicycle tubing used as part of the bicycle frame, handlebars, or other part of the bicycle. Because the bike snap 60 is formed, coupled, or open to one or more slots 26, the flex of the helmet body 24 and the corresponding size change of the slot 26 can allow for the diameter D of the bike snap 60 to be increased so that opposing edges of the bike snap 60 can move around a portion of a bicycle, and then be partially or completely unflexed or relaxed to contact or apply some pressure to the portion of the bike, tubing, or bar disposed within the bike snap 60. Accordingly, the helmet 10 can be snapped onto the bicycle to store or hold the helmet 10 when not in use. For example, a rider may want to take a break from riding, and desire to leave the helmet 10 with the bicycle until the rider has returned after a brief beak or trip to get a drink, use the restroom, make a delivery, or to perform any other task. In such situations, the rider can remove the helmet 10 from his head, temporarily snap the helmet 10 onto the bike for storage using the bike snap 60, and then unsnap the helmet 10 from the bike when the rider is ready to replace the helmet 10 and continue riding.

FIG. 1J shows an instance in which the bike snap 60 comprises a right side bike snap 60*a* opposite a left side bike snap 60*b*. The opposing bike snaps 60*a* and 60*b* can be of a same size and shape or of a different size and shape. By forming multiple bike snap 60 aligned with one another, the helmet 10 can be removably attached to a portion of a bike at opposing sides of the helmet for a more secure fit. While left 14 and right side 16 are used to as opposing sides for multiple bike snaps 60, any opposing sides can be used, including the front 12 and the rear 38 of the helmet 10. Alternatively, a single bike snap 60 can be used for removably attaching the helmet 10 to the bike, tube, bar, or other suitable structure.

FIG. 1K, illustrates a perspective view of an embodiment of the flex spring helmet 10 removably attached to a bar 62 or portion of a bicycle using at least one bike snap 60. When the natural or relaxed state of the helmet 10 includes the diameter D of the bike snap 60 that is slightly smaller than the tubing 62 to which the helmet 10 is attached, then the bike snap 60 applies pressure to the tubing 62 or a portion of the bicycle to removably couple the helmet 10 to the tubing 62. The entrance or opening 64 to the bike snap 60 can be formed at a lower edge of the bike snap 60 along the lower edge 40 of the helmet 10 to allow the tubing 62 to enter the bike snap 60. The width of the opening 64 in a relaxed state can be less than a width of the tubing 62 to prevent the tubing 62 from slipping or falling out of the opening 64.

When forming the helmet 10 as described above, the flex or dynamic range of movement in the helmet 10 resulting from slots 32 in the helmet body 24 together with the use of a rigid foam for the energy-absorbing layer 22 can introduce areas of dynamic weakness into the helmet 10 that can be more likely to break on impact or in a crash event. The areas of dynamic weakness in the helmet 10 tend to be at or around the ends or terminations of slots 26 within the helmet body 24, such as above or around upper ends 46 of lower slots 26*a* and lower ends 52 of upper slots 26*b*. As used herein, around the ends of the slots 26 can include areas or points within 0-3 cm, 0-2 cm, or 0-1 cm of the ends of the slots 26. To overcome the dynamic weakness resulting from the introduction of the slots 26 in the helmet 10 without compromising desired flexibility, a halo or reinforcing band 90 can be included within the helmet 10.

FIGS. 2A-2D show a non-limiting embodiment of the halo 90. The halo 90 can be made of an organic or inorganic material including plastics, polymers, ceramics, metals, metal alloys, carbon fiber, glass fiber, or any other fiber, or any other suitable material formed as a band, belt, strap, web, cage, textile, mesh, net, or fabric that can be made of such materials, proportions, and dimensions as to be flexible, semi-rigid, or rigid. In some embodiments, the halo can be made of Zytrel (St801), glass filled nylon, and can comprise a polished texture. In some instances, the halo 90 can be formed using plastic injection molding. The halo 90 can be included within the helmet body 24 during molding of the helmet body 24 so that the halo 90 is in-molded and integrally formed as part of the flex spring helmet 10. By disposing the halo 90 within the helmet body 24, weakness of the flex helmet 10, including dynamic weakness resulting from the introduction of slots 26 in the helmet body 24 can be reduced or eliminated.

Figure 2A:
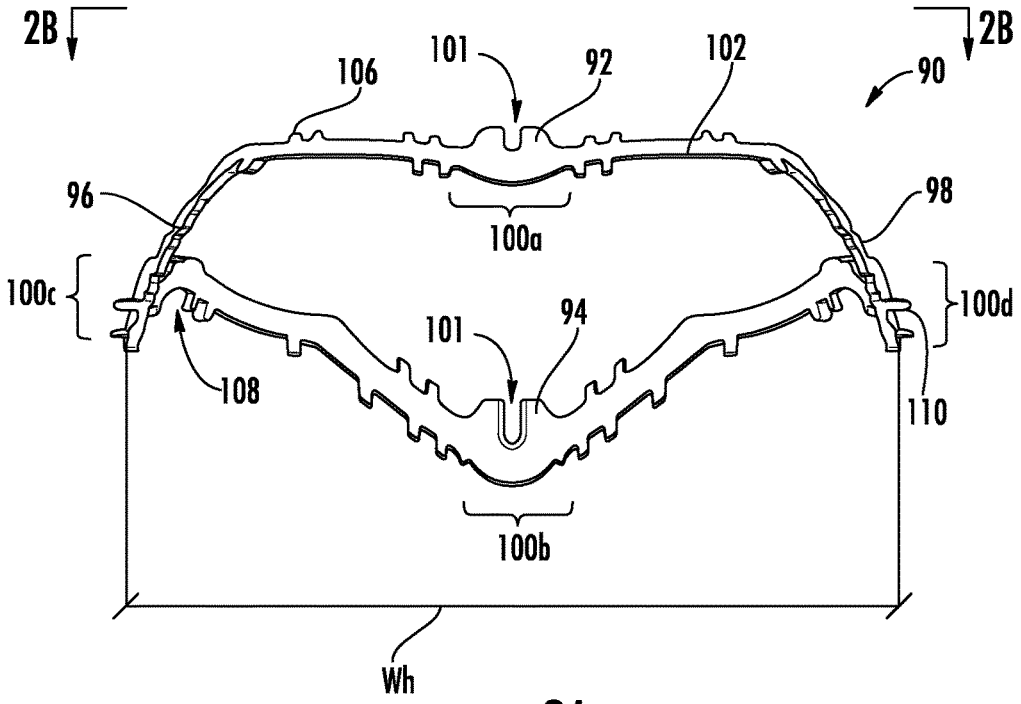
FIGS. 2A-2D show features of a reinforcing halo outside of the flexible helmet.

FIG. 2A shows a front view of the halo 90 that includes various tabs 100*a*, 100*b*, 100*c*, 100*d*, crenellations 106, and angles 108 that can be configured to bond the halo 90 within, and to, the helmet body 24, as well as follow a desirable contour within the helmet body 24 and with respect to positions of the slots 26 so that the halo 90 is not exposed with by the slots 26, but remains completely engulfed or covered by the helmet body 24. Alternatively edges of the halo 90 can be flush, coplanar, or partially exposed along surfaces of the helmet body 24, such as at the outer surface 28, at the inner surface 29, or along slots 26. While FIG. 2A shows an embodiment in which the halo 90 has been formed as a unitary or integrally formed piece, the halo 90 can also be formed of one or more discrete pieces that can be coupled or joined together by connectors, straps, cord, webbing, wire, a web, a frame, a flexible roll cage, or other suitable device that can be made of plastic, metal, textile, fiber, or other suitable material. In either instance, the halo 90 can be in-molded during molding of the foam helmet body 24. In other instances, the halo 90 can be disposed adjacent the inner surface 29 and separate, discrete, or outside of the helmet 10 of the helmet body 24.

The halo 90 can comprise a number of halo tabs that can be formed as flattened and enlarged portions of the halo 90, such that the tabs 100*a*, 100*b*, 100*c*, 100*d* are larger than a band portion 102 of the halo 90. The halo tabs can be integrally formed with the halo 90, or in other instances, can be separate or discrete portions or structures that are subsequently coupled, or attached, to the band portion 102 of the halo 90. The one or more halo tabs, can include a front halo tab 100*a*, a rear halo tab 100*b*, a right halo tab 100*c*, and a left halo tab 100*d* that can be disposed around a circumference of the halo 90. The halo tabs can provide structural reinforcement for weak zones in the helmet body 24 and can optionally include notches 101 that can align with slots 26 and surround ends of the slots 26 to reinforce the helmet body 24 and prevent or reduce breakage, tears, or damage to the helmet body 24.

The halo 90 can also be formed with crenellations, tabs, or ridges disposed along upper and lower sides or surfaces of the band portion 102 of the halo 90 to provide increased surface area and reinforcement for interlocking the halo 90 with the helmet body 24 to prevent slippage or relative movement between the halo 90 and the helmet body 24.

The halo 90 can also be formed with angles or bends 108 that allow for the halo to be directed around the slots 26 in the helmet body 24, and to be aligned with weak zones in the helmet 10 to provide reinforcement at the desired locations. An overall width Wh of the halo 90 can be less than a width between opposing outer surfaces 28 of the helmet body 24 and can also be greater than a width between opposing inner surfaces 29 of the helmet body 24 such that the halo 90 is contained within the helmet body 24. In some instances, the width Wh of the halo 90 can be in a range of 15-20 cm, or about 18.7 cm.

Figure 2B:
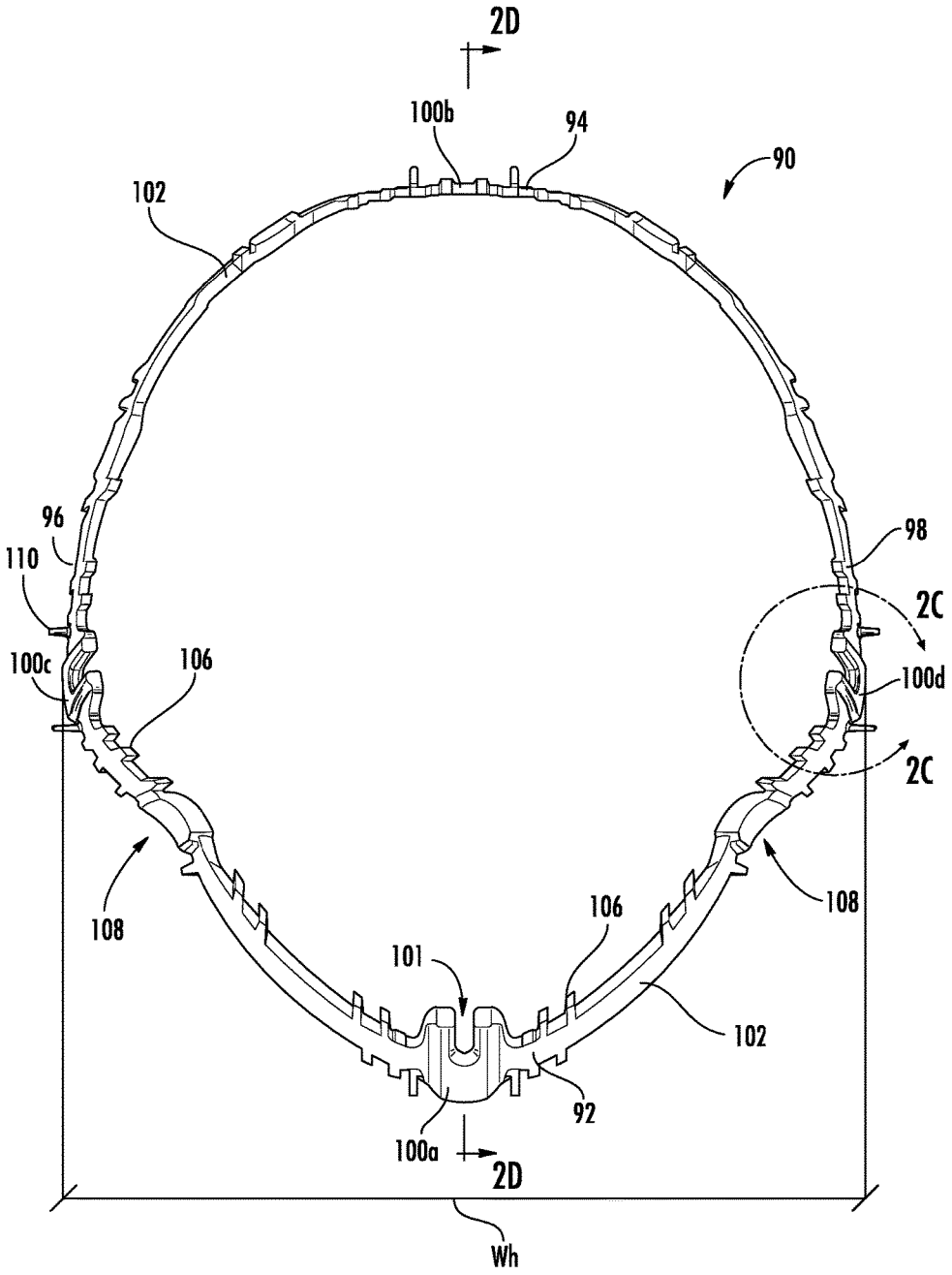

FIG. 2B shows a top or plan view of the halo 90 taken from above the halo 90, as indicated by section line 2B in FIG. 2A. Thus, the plan view of FIG. 2G is perpendicular to the view of FIG. 2A. FIG. 2B shows additional detail of the various features of the halo 90 discussed above. Additionally, FIG. 2B shows that inclusion of extension tabs 110 on halo 90 can increase a width Wh of the halo 90, and can also provide standoff between a surface of a mold into which the energy-absorbing material 22 is injected to form the helmet body 24. A portion of the halo shown within a circular section line 2C on the right side of FIG. 2B is shown in greater detail in FIG. 2C. While halo 90 can be substantially or totally included within the helmet body 24 and hidden from view within the helmet body 24, in other instances the halo 90 can be coupled to the helmet body outside the energy-absorbing layers 22 of the helmet body 24.

Figure 2C:
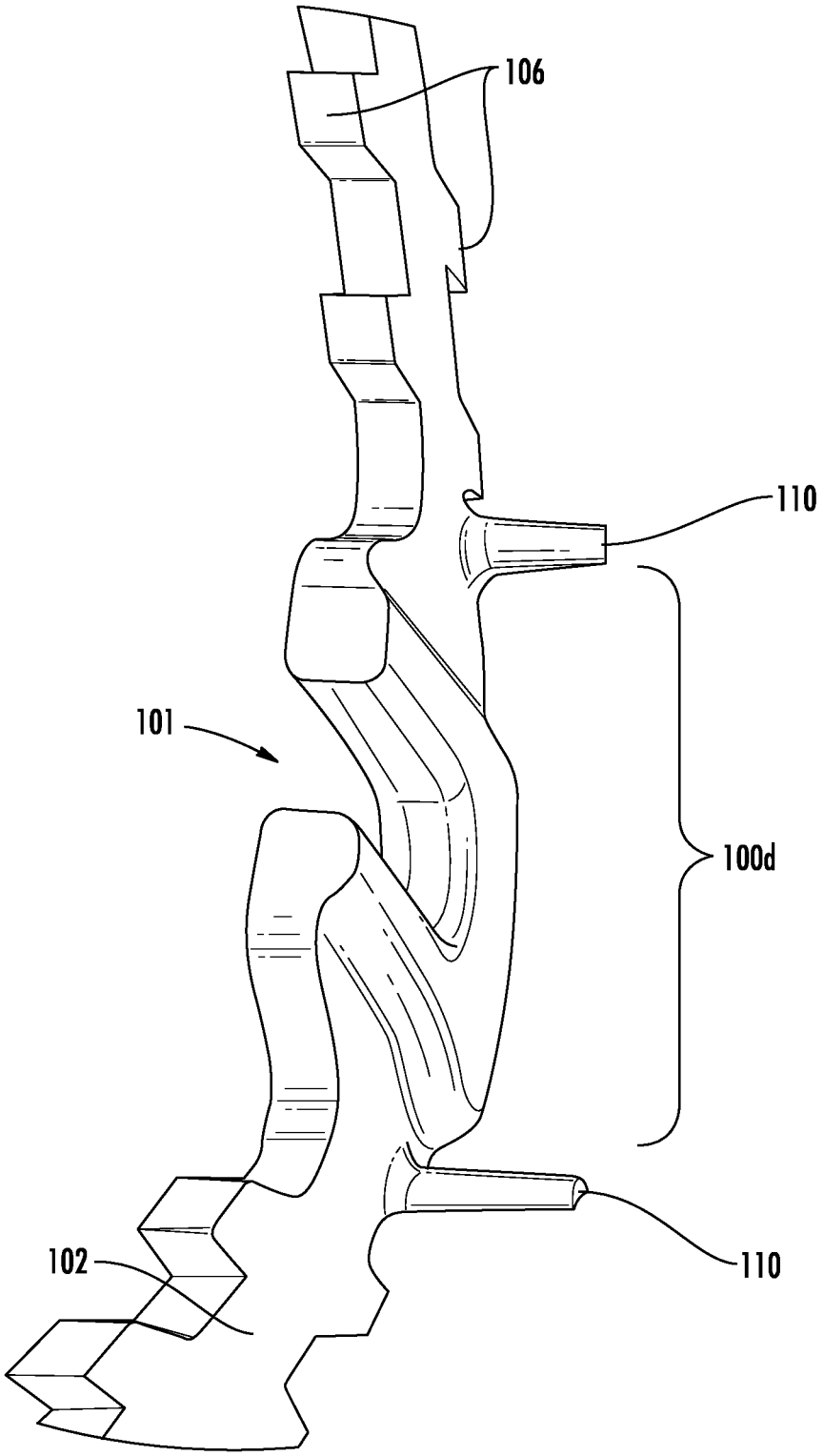
Figure 2D:
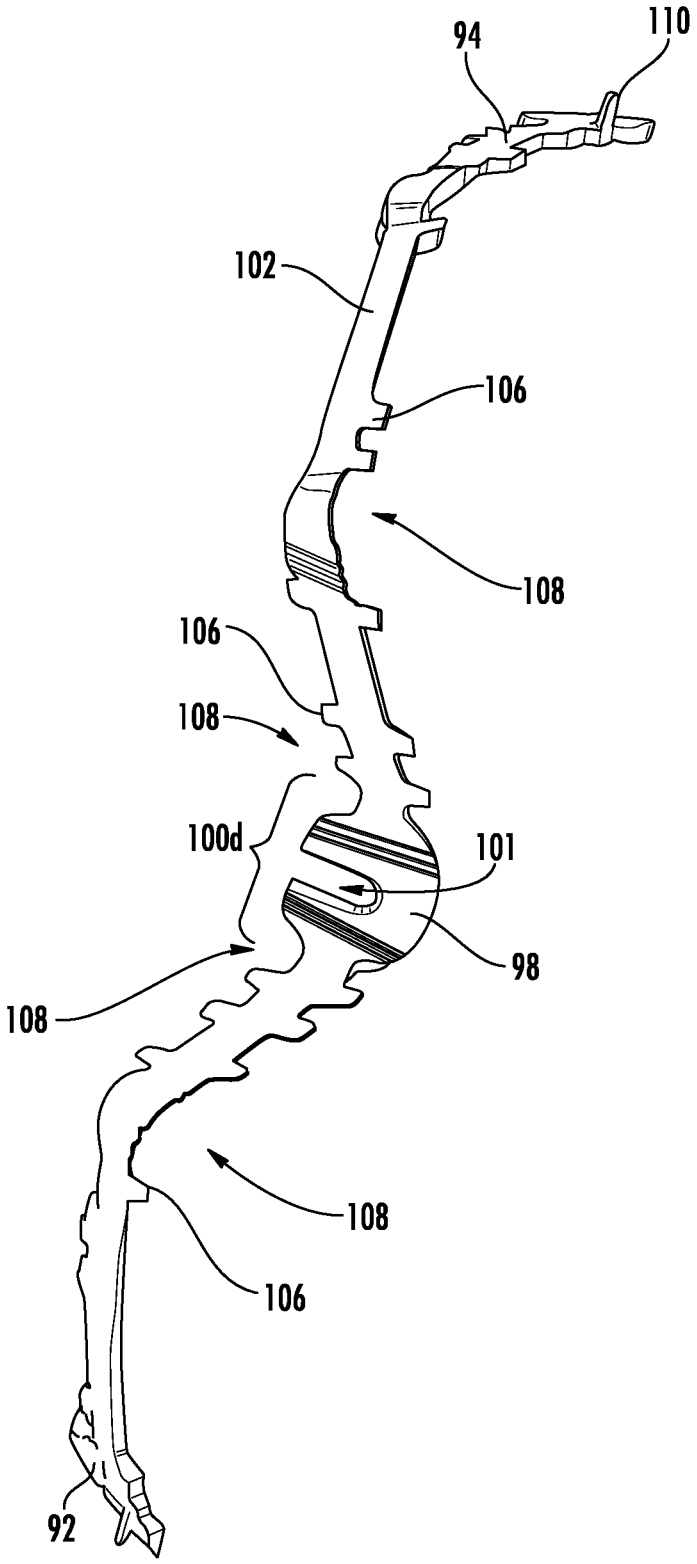

FIGS. 2C and 2D show additional detail of the halo 90 from different views. FIG. 2C, shows a close-up perspective view of the portion or segment of the halo 90 identified in the circular section line 2C shown in FIG. 2B. FIG. 2C also shows additional detail of left halo tab 100*d*, crenellations 106, and extension tabs 110. FIG. 2D shows a side or profile view of the halo 90 that is perpendicular to the front view and plan view of FIG. 2A and FIG. 2B, respectively. FIG. 2D shows a number of angles 108 that can be included as part of the halo 90 to allow for a desired interaction between the halo 90 and the slots 26 of helmet body 24.

Figure 3A:
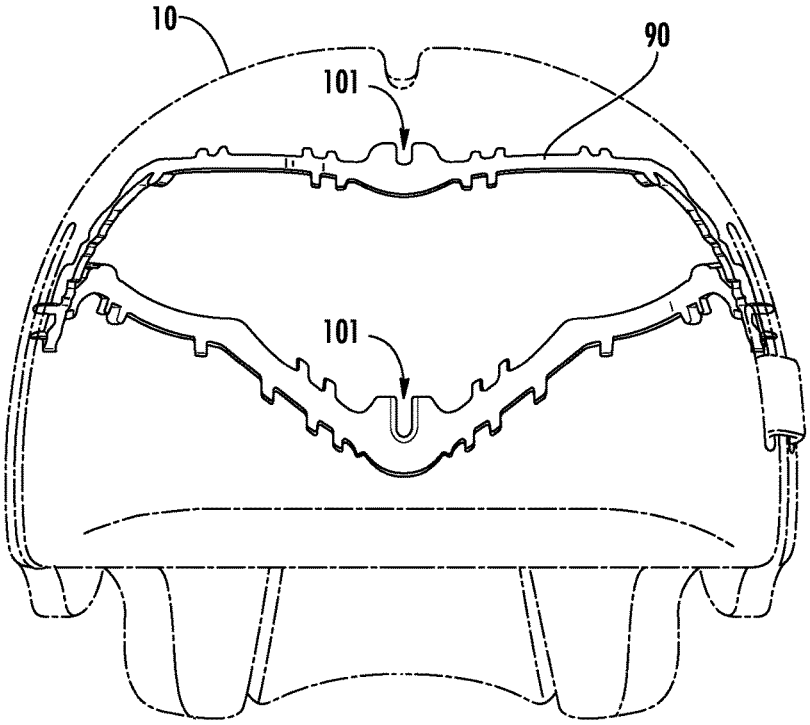
FIGS. 3A and 3B show various views of the reinforcing halo disposed within the flexible helmet.
Figure 3B:
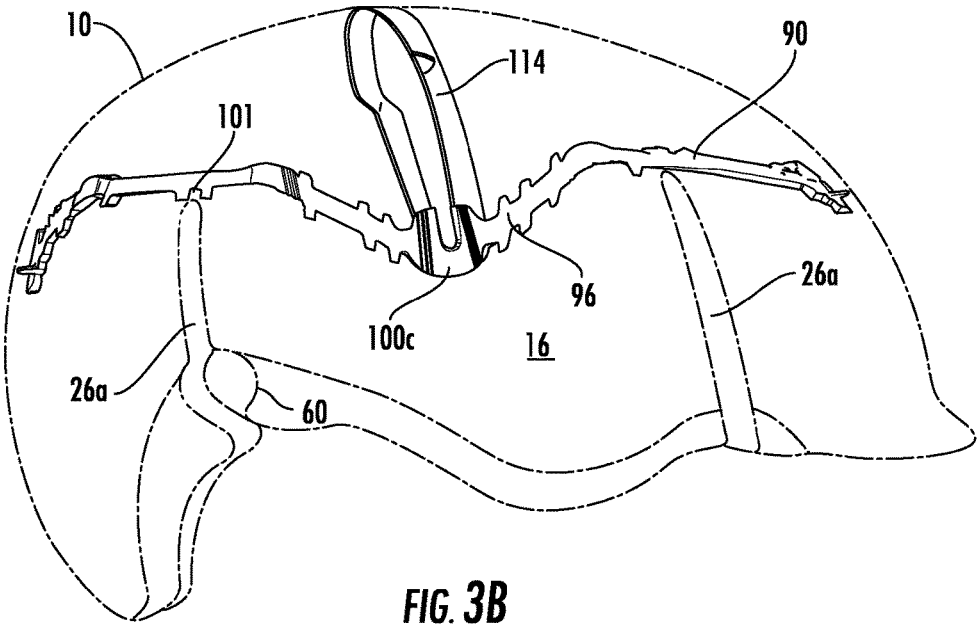

FIGS. 3A and 3B show non-limiting examples of the halo 90 from FIGS. 2A-2D incorporated within the helmet body 24 of FIGS. 1A-1K with the shell of the helmet body 24 made transparent to show the halo 90. More specifically, FIG. 3A shows a front view of the front 12 of the helmet 10 and the front 92 of the halo 90 disposed within the helmet 10. FIG. 3B shows a side view of the right side 16 of the helmet 10 and the right side 96 of the halo 90 within the helmet 10.

FIG. 3B further shows the addition of a runner or strap 114 that can be coupled to opposing right side 96 and left side 98 of the halo 90 while extending through the top portion 18 of the helmet 10, so as to be situated at or over a crown portion of the head of the helmet wearer. While a single runner 114 is shown in FIG. 3B, more than one or a plurality of runners 114 can be coupled or integrally formed with the halo 90, and with each other. Like the halo 90, the one or more runners 114 can be included within energy-absorbing material 22 of the helmet body 24 for reinforcing and strengthening the helmet 10 and one or more areas of weakness within the helmet 10 that might exist before including the halo 90 and the runners 114 and result from slots 26 being formed in the energy-absorbing material 22 for providing flexibility. The runners 114 can be formed from materials, and in a manner similar or identical to, that of the halo 90. In other embodiments, portions of the runners 114, including an entirety of the runners 114 can be formed of materials and with geometries different from those of the halo 90. In some embodiments, a runner 114 can be coupled at or near the halos tabs of the halo 90, such as at the right halo tab 100*c* and the left halo tab 100*d*.

Where the above examples, embodiments and implementations reference examples, it should be understood by those of ordinary skill in the art that other helmet and manufacturing devices and examples could be intermixed or substituted with those provided as virtually any components consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation.

In places where the description above refers to particular embodiments of a flexible helmet, it should be readily apparent that a number of modifications may be made without departing from the spirit thereof and that these embodiments and implementations may be applied to other to gear and equipment technologies as well. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. A helmet comprising:

a helmet body formed of a foam energy-absorbing material, the helmet body comprising an outer surface and an inner surface opposite the outer surface;

a plurality of lower slots formed in the helmet body that extend completely through the helmet body from the outer surface to the inner surface, the plurality of lower slots being open at a lower edge of the helmet body;

a plurality of upper slots formed in the helmet body that extend completely through the helmet body from the outer surface to the inner surface, wherein the plurality of upper slots are separate from and do not intersect with the plurality of lower slots, and the plurality of upper slots intersect with each other at a top portion of the helmet body to form a star shape;

wherein a shape of a continuous portion of the helmet body forms an S-shaped panel between a lower end of one of the plurality of upper slots extending from the top portion of the helmet body to between upper ends of two of the plurality of lower slots; and a reinforcing halo disposed within the helmet body to reinforce areas of weakness in the helmet body resulting from the plurality of lower slots and the plurality of upper slots.

2. The helmet of claim 1, wherein the plurality of lower slots and the plurality of upper slots comprises an upper slot crossing a connecting line formed between upper ends of two lower slots by a distance in a range of 2-5 centimeters (cm).

3. The helmet of claim 2, wherein the foam energy-absorbing material comprising EPS, EPP, EPTU, or EPO.

4. The helmet of claim 3, wherein the helmet is configured such that a force in a range of 22-66 Newtons applied to the helmet will reduce a width of one of the plurality of upper slots or one of the plurality of lower slots by a distance greater than or equal to 5 millimeters (mm).

5. The helmet of claim 1, wherein a side portion of the helmet comprises a total of at least three slots.

6. The helmet of claim 5, wherein at least one of the plurality of upper slots or at least one of the plurality of lower slots comprises a height Hs in a range of 7.5-15.5 centimeters (cm).

7. The helmet of claim 1, wherein the reinforcing halo comprises an annular shape and is disposed within the S-shaped panel without being exposed by the plurality of lower slots or the plurality of upper slots.

8. A helmet comprising:

a helmet body formed of a foam energy-absorbing material, the helmet body comprising an outer surface and an inner surface opposite the outer surface;

a plurality of lower slots formed in the helmet body that extend completely through the helmet body from the outer surface to the inner surface, the plurality of lower slots being open at a lower edge of the helmet body;

a plurality of upper slots, separate from and not intersected with the plurality of lower slots, formed in the helmet body that extend completely through the helmet body from the outer surface to the inner surface, the plurality of upper slots being intersected with each other at a top portion of the helmet body; and wherein a shape of a continuous portion of the helmet body forms an S-shaped panel between a lower end of one of the plurality of upper slots extending from the top portion of the helmet body to between upper ends of two of the plurality of lower slots.

9. The helmet of claim 8, further comprising straps disposed through openings in the helmet body at opposing sides of the lower plurality of slots.

10. The helmet of claim 8, wherein the helmet is formed of a unitary helmet body without an outer shell disposed over the helmet body.

11. The helmet of claim 10, further comprising a bike snap disposed within the helmet body and extending from the outer surface to the inner surface.

12. The helmet of claim 10, wherein the foam energy-absorbing material comprising EPS, EPP, EPTU, or EPO.

13. The helmet of claim 12, wherein the plurality of lower slots and the plurality of upper slots comprises an upper slot crossing a connecting line formed between upper ends of two lower slots by a distance in a range of 2-5 centimeters (cm).

14. The helmet of claim 13, further comprising an annular shape halo in-molded within the S-shaped panel of the helmet body without the halo being exposed by the plurality of lower slots or the plurality of upper slots.

15. A helmet comprising:

a helmet body formed of a foam energy-absorbing material, the helmet body comprising an outer surface and an inner surface opposite the outer surface;

a plurality of lower slots formed in the helmet body that extend completely through the helmet body from the outer surface to the inner surface, the plurality of lower slots being open at a lower edge of the helmet body; and a plurality of upper slots formed separate from and not intersected with the plurality of lower slots in the helmet body that extend completely through the helmet body from the outer surface to the inner surface, the plurality of upper slots being continuous with each other at a top portion of the helmet body;

wherein the plurality of lower slots and the plurality of upper slots comprises an upper slot crossing a connecting line formed between upper ends of two lower slots by a distance in a range of 2-5 centimeters (cm).

16. The helmet of claim 15, further comprising straps disposed through openings in the helmet body at opposing sides of the lower plurality of slots.

17. The helmet of claim 15, wherein the helmet is formed without an outer shell disposed over the helmet body.

18. The helmet of claim 17, wherein the foam energy-absorbing material comprising EPS, EPP, EPTU, or EPO.

19. The helmet of claim 15, further comprising an annular shape halo in-molded within an S-shaped panel of the helmet body without the halo being exposed by the plurality of lower slots or the plurality of upper slots.

20. The helmet of claim 15, wherein a shape of a continuous portion of the helmet body forms an S-shaped panel between a lower end of one of the plurality of upper slots to between upper ends of two of the plurality of lower slots.

* * * * *